US008875601B2

(12) United States Patent
Johnson et al.

(10) Patent No.: US 8,875,601 B2
(45) **Date of Patent: *Nov. 4, 2014**

(54) BIAXIAL FOLDOUT TOOL WITH MULTIPLE TOOLS ON A SIDE AND A ROTATIONAL STOP

(71) Applicant: WAGIC, Inc., Los Gatos, CA (US)

(72) Inventors: Ronald L. Johnson, San Jose, CA (US); Robert J. Gallegos, Fremont, CA (US); Steven Simas Escobar, San Jose, CA (US); Idriss Mansouri-Chafik Ruiz, Santa Clara, CA (US); Yugen Patrick Lockhart, Palo Alto, CA (US)

(73) Assignee: WAGIC, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/908,703

(22) Filed: Jun. 3, 2013

(65) Prior Publication Data

US 2013/0263703 A1 Oct. 10, 2013

Related U.S. Application Data

(63) Continuation of application No. 12/567,606, filed on Sep. 25, 2009, now Pat. No. 8,468,916, which is a continuation-in-part of application No. 12/009,461, filed on Jan. 17, 2008.

(51) Int. Cl.

| | |
|---|---|
| ***B25B 23/16*** | (2006.01) |
| ***B25G 1/08*** | (2006.01) |
| ***B25F 1/04*** | (2006.01) |
| ***B25G 1/06*** | (2006.01) |
| ***B25B 15/00*** | (2006.01) |

(52) U.S. Cl.

CPC . *B25F 1/04* (2013.01); *B25G 1/066* (2013.01); *B25B 15/008* (2013.01)

USPC ..... 81/440; 81/177.4; 7/168

(58) Field of Classification Search

USPC ..... 81/177.4, 177.6, 437–440; 7/118, 167, 7/168; 206/374, 375, 377

See application file for complete search history.

(56) References Cited

U.S. PATENT DOCUMENTS

| | | | | |
|---|---|---|---|---|
| 2,590,307 | A | 3/1953 | Gibson | |
| 3,370,696 | A | 2/1968 | Groe | |
| 4,327,790 | A | 5/1982 | Stevens et al. | |
| D284,810 | S | 7/1986 | Kelemen, Sr. | |
| 4,815,346 | A * | 3/1989 | Littlehorn | 81/439 |
| 5,320,004 | A * | 6/1994 | Hsiao | 81/440 |
| 5,581,834 | A * | 12/1996 | Collins | 7/118 |

(Continued)

*Primary Examiner* — David B Thomas

(74) *Attorney, Agent, or Firm* — Haverstock & Owens LLP

(57) ABSTRACT

A biaxial foldout tool includes a body with opposing ends and one or more sets of tool drivers. The opposing ends are rotated 90° from each other. A first set of tool drivers is positioned on/near a first end and rotates about a first hinge; a second set of tool drivers is positioned on/near a second end and rotates about a second hinge. A first portion of the first set opens in a direction counter to an open direction of a second portion of the first set of tool drivers. A first portion of the second set opens in a direction counter to an open direction of a second portion of the second set of tool drivers. When tool drivers are in an open position, internal stops prevent the tool drivers from opening past a predetermined angle. The tool drivers are contained within channels of the body when in a closed position.

20 Claims, 18 Drawing Sheets

(56) References Cited

U.S. PATENT DOCUMENTS

| | | | | |
|---|---|---|---|---|
| 5,692,656 | A | 12/1997 | Dembicks | |
| 5,803,584 | A | 9/1998 | Chung | |
| 5,938,028 | A | 8/1999 | Hu | |
| 5,983,759 | A | 11/1999 | Turner | |
| 6,088,861 | A * | 7/2000 | Sessions et al. | 7/128 |
| D433,613 | S | 11/2000 | Jialin | |
| 6,202,864 | B1 | 3/2001 | Ernst et al. | |
| D440,852 | S | 4/2001 | Ernst | |
| 6,257,106 | B1 * | 7/2001 | Anderson et al. | 81/440 |
| 6,279,435 | B1 * | 8/2001 | Zayat, Jr. | 81/440 |
| 6,357,068 | B1 * | 3/2002 | Seber et al. | 7/129 |
| D461,311 | S | 8/2002 | Gharib | |
| 6,601,481 | B2 | 8/2003 | Chuang | |
| 6,640,675 | B1 * | 11/2003 | Chuang | 81/490 |
| 7,047,847 | B2 | 5/2006 | Chuang | |
| D548,464 | S | 8/2007 | Lin | |
| 7,409,894 | B1 | 8/2008 | Valentine | |
| D604,509 | S | 11/2009 | Andrews | |
| 7,810,415 | B2 * | 10/2010 | Adamany et al. | 81/440 |
| 7,846,203 | B2 | 12/2010 | Cribier | |
| 8,468,916 | B2 * | 6/2013 | Johnson et al. | 81/440 |
| 2001/0045145 | A1 * | 11/2001 | Legg | 81/440 |
| 2008/0164171 | A1 | 7/2008 | Meng | |

* cited by examiner

BIAXIAL FOLDOUT TOOL WITH MULTIPLE TOOLS ON A SIDE AND A ROTATIONAL STOP

RELATED APPLICATIONS

This patent application is a continuation of the co-pending U.S. patent application Ser. No. 12/567,606, filed Sep. 25, 2009, entitled "BIAXIAL FOLDOUT TOOL WITH MULTIPLE TOOLS ON A SIDE AND A ROTATIONAL STOP," which is a continuation-in-part of the co-pending U.S. patent application Ser. No. 12/009,461, filed Jan. 17, 2008, entitled "RADIAL FOLDOUT TOOL. The U.S. patent application Ser. No. 12/567,606, filed Sep. 25, 2009, entitled "BIAXIAL FOLDOUT TOOL WITH MULTIPLE TOOLS ON A SIDE AND A ROTATIONAL STOP and the U.S. patent application Ser. No. 12/009,461, filed Jan. 17, 2008, entitled "RADIAL FOLDOUT TOOL are both hereby incorporated by reference.

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as alien wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English (e.g., standard) and metric sizes in order to facilitate their use with screw heads of multiple sizes. Such wrenches are usually sold in a set which includes wrenches of multiple sizes but are also distributed individually.

When using a hexagonal wrench, a user will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

A radial foldout tool includes a body with opposing ends and one or more sets of tool drivers. A first set of tool drivers are positioned on/near a first end and a second set of tool drivers are positioned on/near a second end. The tool drivers are contained within channels of the body when in a closed position. The tool drivers are also contained in a plurality of planes. The tool drivers open by rotating/moving in a direction at least perpendicular to a neighboring tool driver. When they are in an open position, each of the tool drivers are in/near the center of the end of the body. By being positioned in/near the center of the end, the radial foldout tool is able to be gripped and turned in a fashion similar to a standard screwdriver.

In one aspect, a device comprises a body having a center, a first end and a second end, wherein the first end and the second end are positioned on opposite ends of the body and a first set of tool drivers positioned within the body in a plurality of planes, wherein each tool driver of the first set of tool drivers is configured to be positioned generally in the center out of the first end in an open position. The device further comprises a second set of tool drivers positioned within the body in the plurality of planes, wherein the second set of tool drivers are configured to be positioned out of the second end. The first set of tool drivers and the second set of tool drivers are positioned within the body in a closed position. Each tool driver of the second set of tool drivers is positioned out of the second end in an open position. Each tool driver of the second set of tool drivers is positioned generally in the center of the second end in an open position. In some embodiments, a first tool driver of the first set of tool drivers is in the same plane as a second tool driver of the second set of tool drivers. The body includes a set of channels for the first set of tool drivers and the second set of tool drivers to be positioned in the closed position. In some embodiments, each tool driver of the first set of tool drivers is positioned at least 90° around the circumference of the first end away from a neighboring tool driver and each tool driver of the second set of tool drivers is positioned at least 90° around the circumference of the second end away from a neighboring tool driver. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers from opening further. In some embodiments, each of the first set of tool drivers do not open further than 180°.

In another aspect, a device comprises a body having a center, the body including a plurality of faces, a first end and a second end, wherein the first end and the second end are positioned on opposite ends of the body, a first set of tool drivers, each tool driver of the first set of tool drivers positioned within the body on a face of the plurality of faces, wherein the first set of tool drivers are configured to be positioned generally in the center out of the first end in an open position and a second set of tool drivers, each tool driver of the second set of tool drivers positioned on a face of the plurality of faces within the body, wherein the first set of tool drivers are configured to be positioned generally in the center out of the second end in an open position. The first set of tool drivers and the second set of tool drivers are positioned within the body in a closed position. In some embodiments, a first tool driver of the first set of tool drivers is in the same plane as a second tool driver of the second set of tool drivers. The body includes a set of channels for the first set of tool drivers and the second set of tool drivers to be positioned in the closed position. Each tool driver of the first set of tool drivers and the second set of tool drivers is positioned in the open position by rotation in a substantially perpendicular direction away from the face. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers and the second set of tool drivers from opening further.

In yet another aspect, a generally cylindrical tool handle having a body with a center, a first end and a second end and a generally cylindrical surface, the handle including a plurality of tool drivers each of a differing size in a plurality of planes, wherein each of the plurality of tool drivers includes an elongated rod coupled with the tool handle having a bend through a predetermined angle and including a proximal end for engaging an object, and a mounting end between the bend and a distal end, further wherein each tool driver of the set of tool drivers is positioned generally in the center of one of the first end and the second end in an open position. The set of tool drivers are positioned within the body in a closed position. In some embodiments, each tool driver of the set of tool drivers is positioned at least 90° around the circumference of one of the first end and the second end away from a neighboring tool driver. The tool handle further comprises a stop within the body for preventing each tool driver of the set of tool drivers from opening further.

In yet another aspect, a device comprises a body. The body includes a first face opposite a third face, a second face opposite a fourth face, and a first end opposite a second end, wherein the first end and the second end are rotated 90° from each other. A portion of each face is typically represented on each end. The device further comprises a first hinge located at the first end, wherein the first hinge couples together the second face and the fourth face, and a first set of tool drivers positioned within the body, wherein each tool driver of the first set of tool drivers is configured to rotate about the first hinge. A first portion of the first set of tool drivers is positioned within the first face and a second portion of the first set of tool drivers is positioned within the third face of the body in a closed position. Tool drivers of the first portion of the first set open in a direction counter to an open direction of tool drivers of the second portion of the first set. Tool drivers of the first portion of the first set are positioned within the first face according to size, and tool drivers of the second portion of the first set are positioned within the third face according to size. The device further comprises a first internal stop on the first face configured to prevent tool drivers of the second portion of the first set from opening past 180°, and a second internal stop on the third face configured to prevent tool drivers of the first portion of the first set from opening past 180°. In some embodiments, the device further comprises a second hinge located at the second end, wherein the second hinge couples together the first face and the third face, and a second set of tool drivers positioned within the body, wherein each tool driver of the second set of tool drivers is configured to rotate about the second hinge. A first portion of the second set of tool drivers is positioned within the second face and a second portion of the second set of tool drivers is positioned within the fourth face of the body in a closed position. Tool drivers of the first portion of the second set open in a direction counter to an open direction of tool drivers of the second portion of the second set. Tool drivers of the first portion of the second set are positioned within the second face according to size, and tool drivers of the second portion of the second set are positioned within the fourth face according to size. The device further comprises a first internal stop on the second face configured to prevent tool drivers of the second portion of the second set from opening past 180°, and a second internal stop on the fourth face configured to prevent tool drivers of the first portion of the second set from opening past 180°.

In yet another aspect, a tool comprises a body including a plurality of sides, a first end and a second end, wherein the first end and the second end are twisted 90° from each other, a plurality of hinges including a first hinge and a second hinge, wherein the first hinge couples together a second side and a fourth side, wherein the second hinge couples together a first side with a third side, a first set of tool drivers configured to rotate about the first hinge, and a second set of tool drivers configured to rotate about the second hinge. Tool drivers of the first set of tool drivers and the second set of tool drivers fit securely within channels of the body. A first portion of the first set of tool drivers is positioned within the first side of the body and a second portion of the first set of tool drivers is positioned within the third face of the body in a closed position. Tool drivers of the first portion of the first set are arranged according to size, and tool drivers of the second portion of the first set are arranged according to size. The tool further comprises a first stop integral to the first face configured to prevent tool drivers of the second portion of the first set from opening past 180°, and a second stop integral to the third face configured to prevent tool drivers of the first portion of the first set from opening past 180°. A first portion of the second set of tool drivers is positioned within the second face and a second portion of the second set of tool drivers is positioned with the fourth face of the body in a closed position. Tool drivers of the first portion of the second set are arranged according to size, and tool drivers of the second portion of the second set are arranged according to size. The tool further comprises a first stop integral to the second face configured to prevent tool drivers of the second portion of the second set from opening past 180°, and a second stop integral to the fourth face configured to prevent tool drivers of the first portion of the second set from opening past 180°.

In yet another aspect, an apparatus comprises a body including a first end and a second end, wherein the first end has a first hinge and the second end has a second hinge, further wherein the first end and the second end are rotated 90° from each other, a first set of tool drivers coupled to and rotates about the first hinge, wherein a first subset of the first set of tool drivers is positioned within a first side of the body in order of size and a second subset of the first set of tool drivers is positioned within a third side of the body in order of size, further wherein the first side and third side are opposite sides of the body, a second set of tool drivers coupled to and rotates about the second hinge, wherein a first subset of the second set of tool drivers is positioned within a second side of the body in order of size and a second subset of the second set of tool drivers is positioned within a fourth side of the body in order of size, further wherein the second side and the fourth side are opposite sides of the body, and a plurality of internal stops. The plurality of internal stops includes a first internal stop at a distal end of the second hinge on the first side, the first internal stop configured to prevent tool drivers of the second subset of the first set of tool drivers from opening past 180°, a second internal stop at a distal end of the first hinge on the second side, the second internal stop configured to prevent tool drivers of the second subset of the second set of tool drivers from opening past 180°, a third internal stop at a distal end of the second hinge on the third side, the third internal stop configured to prevent tool drivers of the first subset of the first set of tool drivers from opening past 180°, and a fourth internal stop at a distal end of the first hinge on the fourth side, the fourth internal stop configured to prevent tool drivers of the first subset of the second set of tool drivers from opening past 180°.

In yet another aspect, a tool handle comprising a body with a generally cylindrical surface, the body comprises four sides, wherein each side has a plurality of tool drivers coupled to a first end via a hinge, a recessed area at an opposite end to receive an end of another hinge, and an internal stop near the first end configured to prevent a portion of the plurality of the tool drivers from opening past a predetermined angle. In some embodiments, the predetermined angle is 180°. In other embodiments, the predetermined angle is 90°.

DETAILED DESCRIPTION

In the following description, numerous details are set forth for purposes of explanation. However, one of ordinary skill in the art will realize that the invention may be practiced without the use of these specific details or with equivalent alternatives. Thus, the present invention is not intended to be limited to the embodiments shown but is to be accorded the widest scope consistent with the principles and features described herein.

Reference will now be made in detail to implementations of the present invention as illustrated in the accompanying drawings. The same reference indicators will be used throughout the drawings and the following detailed description to refer to the same or like parts.

Embodiments of the present invention are directed to a foldout tool that stores tool drivers in a compact configuration. The tool drivers are able to be positioned for use to tighten or loosen an object such as a screw or bolt.

Radial Foldout Tool

Figure 1:
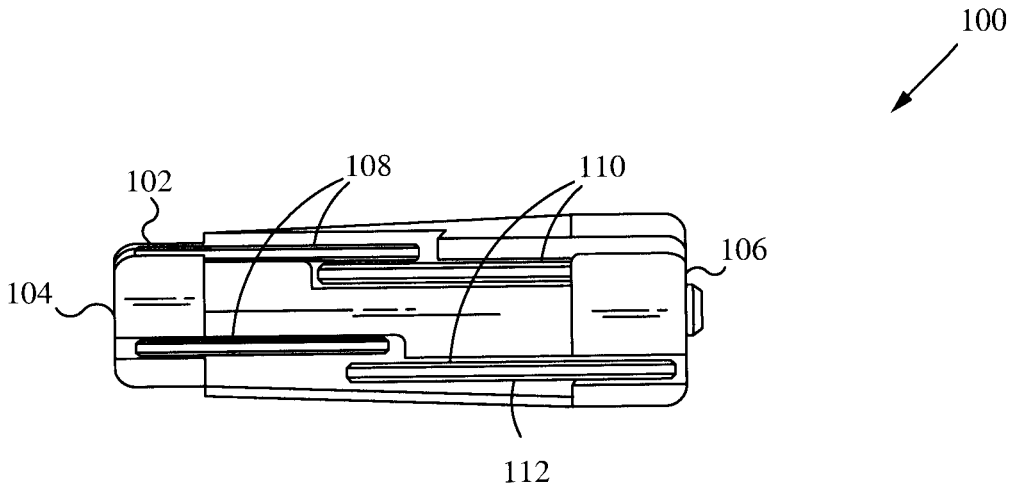
FIG. 1 illustrates an isometric view of a radial foldout tool in a closed position in accordance with the present invention.

FIG. 1 illustrates an isometric view of a radial foldout tool 100 in a closed position in accordance with the present invention. A first set of tool drivers 108 is coupled to or near a first end 104 of a body 102 of the radial foldout tool 100. Each tool driver 112 of the first set of tool drivers 108 is coupled so that it is able to rotate out to an open position. In some embodiments, each of the first set of tool drivers 108, when stored in a closed position, fits securely within a different channel of the body 102. A second set of tool drivers 110 is coupled to or near a second end 106 of the body 102 of the radial foldout tool 100. Each tool driver 112 of the second set of tool drivers 110 is coupled so that it is able to rotate out to an open position. In some embodiments, each of the second set of tool drivers 110, when stored in a closed position, fits securely within a different channel of the body 102.

In some embodiments, each of the tool drivers 112 of the first set of tool drivers 108 is positioned in the body 102 in a different plane from the other tool drivers of the first set of tool drivers 108. Similarly, in some embodiments, each of the tool drivers 112 of the second set of tool drivers 110 is positioned in the body 102 in a different plane from the other tool drivers of the second set of tool drivers 110. For example, in a radial foldout tool 100 which has a body 102 that is generally cylindrical in shape and surface, a first tool driver is positioned at 0° along the circumference of a round first end of the tool, a second tool driver is positioned at 120° along the circumference and a third tool driver is positioned at 240° along the circumference. Tool drivers are similarly positioned on the opposite end as well.

In some embodiments, each tool driver of the first set of tool drivers 108 is positioned in the same plane as a correspondingly positioned tool driver of the second set of tool drivers 110.

In some embodiments, each of the tool drivers of the radial foldout tool 100 is configured to open at least perpendicularly to its neighboring tool driver. For example, with a radial foldout tool 100 containing three tool drivers at each end, a first tool driver opens at 0°, a second tool driver opens at 90° and a third tool driver opens at 270°. This configuration enables each of the tool drivers to open into/near the middle/center of the end, so that a user has better and easier turning power instead of the awkward turning capabilities when the tool drivers are not positioned near the middle of the end. In other words, each of the tool drivers fold out to a position as close as possible to a central axis of the radial foldout tool 100.

In some embodiments, a hard stop such as an internal wall prevents the tool drivers from opening past a certain angle such as 180° so that the tool extends perpendicular to the corresponding end.

Figure 2:
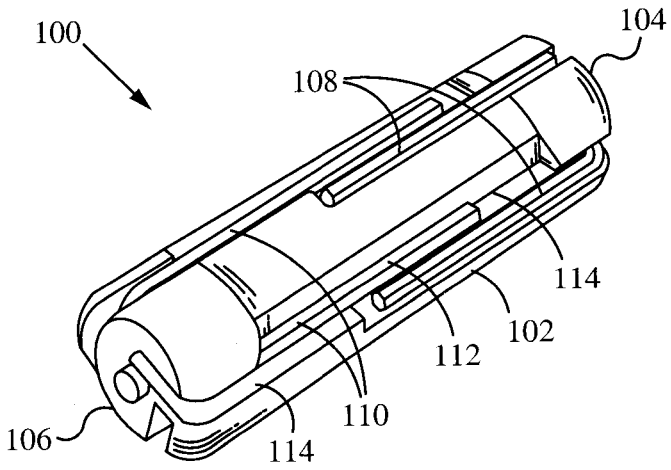
FIG. 2 illustrates a perspective view of a radial foldout tool in a closed position in accordance with the present invention.

FIG. 2 illustrates a perspective view of a radial foldout tool 100 in a closed position in accordance with the present invention. A first set of tool drivers 108 is coupled to or near a first end 104 of a body 102 of the radial foldout tool 100. The first set of tool drivers 108 is coupled so that the tool drivers 112 are able to rotate out to an open position. In some embodiments, each of the first set of tool drivers 108, when stored in a closed position, fits securely within a different channel 114 of the body 102. A second set of tool drivers 110 is coupled to or near a second end 106 of the body 102 of the radial foldout tool 100. The second set of tool drivers 110 is coupled so that the tool drivers 112 are able to rotate out to an open position. In some embodiments, each of the second set of tool drivers 110, when stored in a closed position, fits securely within a different channel 114 of the body 102.

Figure 3:
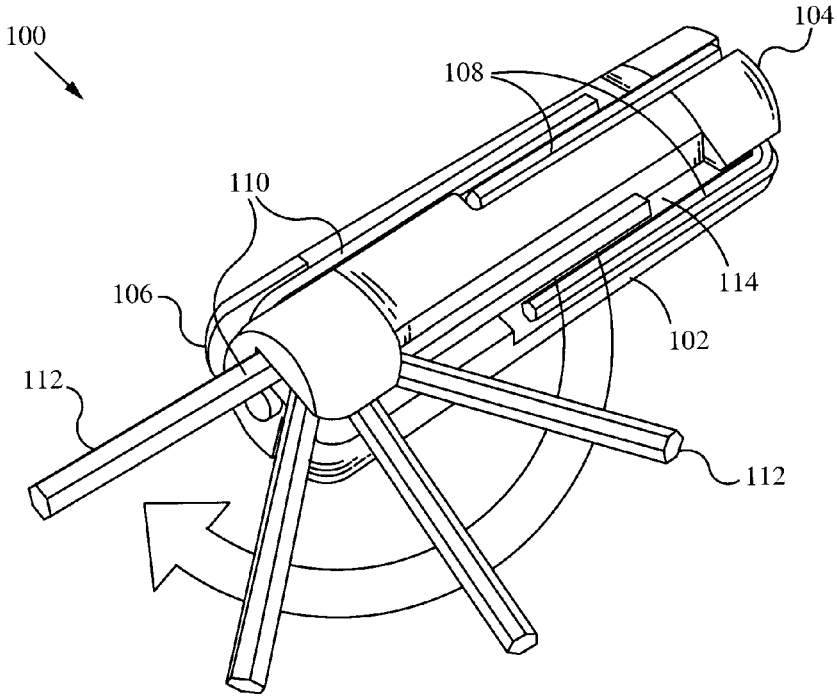
FIG. 3 illustrates a perspective view of a radial foldout tool with a tool driver moving from a closed position to an open position in accordance with the present invention.

FIG. 3 illustrates a perspective view of a radial foldout tool 100 with a tool driver moving from a closed position to an open position in accordance with the present invention. When positioned in a closed position, the tool driver 112 is stored within a channel 114, in some embodiments. A user is able to rotate the tool driver 112 to an open position as shown. In some embodiments, the tool driver 112 is limited in the direction it is able to rotate, such that it rotates away from the channel 114 in which it is stored. Furthermore, the tool driver's rotational range is limited so that the tool driver 112 stops rotating once it is pointing in a parallel direction to the body 102. In an open position, the tool driver 112 is also generally in the middle of the end of the body 102. In other words, the tool driver 112 folds out to a position as close as possible to the central axis of the radial foldout tool 100. To position the tool driver 112 in a closed position, a user rotates the tool driver 112 in an opposite direction from the opening direction so that the tool driver 112 rests within the channel 114, in some embodiments.

Figure 4:
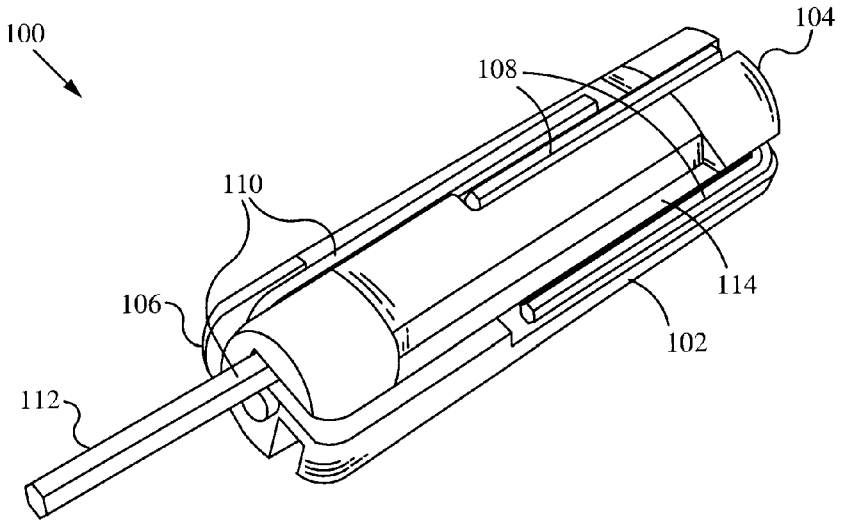
FIG. 4 illustrates a perspective view of a radial foldout tool in an open position in accordance with the present invention.

FIG. 4 illustrates a perspective view of a radial foldout tool 100 in an open position in accordance with the present invention. When in an open position, a tool driver 112 is positioned pointing in a parallel direction to the body 102 and generally in the middle of the end of the body 102, in some embodiments. This enables users to grip the body 102 as a handle and use the radial foldout tool 100 similarly to a screw driver or other tool that has a body with a tool driver protruding out of the middle of the handle. The radial foldout tool 100 is intended to be used with one of the tool drivers 112 in an open position. While one of the tool drivers 112 is in an open position, the other tool drivers 112 are typically in a closed position.

Figure 5:
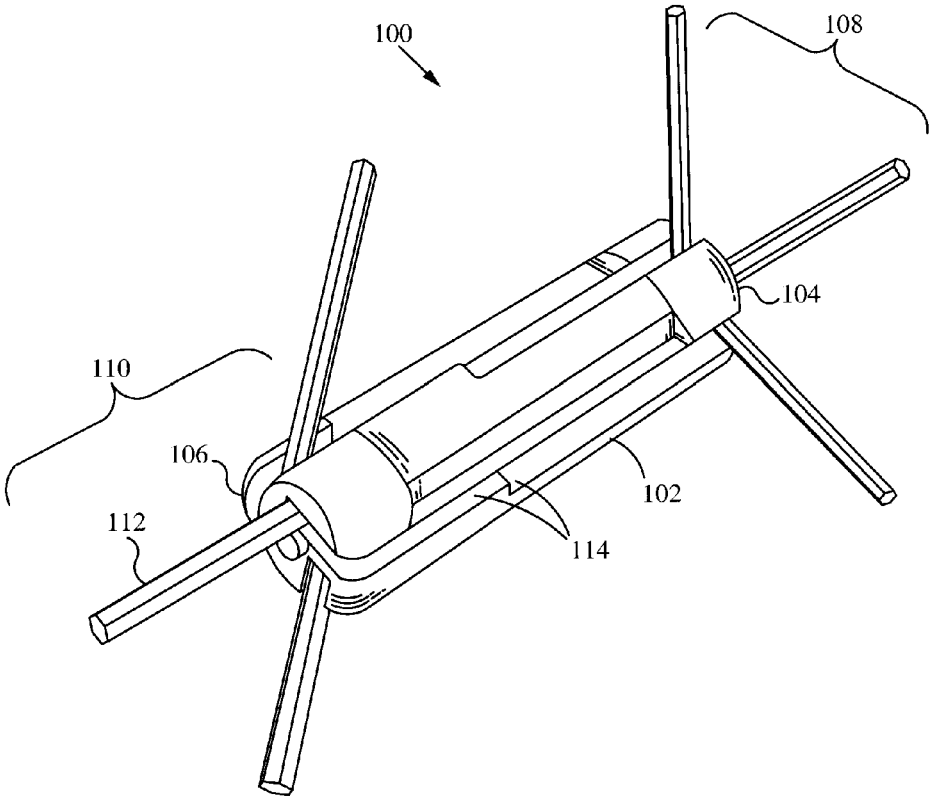
FIG. 5 illustrates a perspective view of a radial foldout tool with all of the tool drivers in an open or partially open position in accordance with the present invention.

FIG. 5 illustrates a perspective view of a radial foldout tool 100 with all of the tool drivers in an open or partially open position in accordance with the present invention. The drawing of FIG. 5 is for illustration purposes only. When in use, the radial foldout tool 100 is designed to work with one tool driver open at a time.

In some embodiments, the radial foldout tool 100 is designed to include some hexagonal wrenches of English (e.g., standard) sizes including a ¼ inch hexagonal wrench, a 7/32 inch hexagonal wrench, a 3/16 inch hexagonal wrench, a 5/32 inch hexagonal wrench, a 9/64 inch hexagonal wrench, a ⅛ inch hexagonal wrench, a 7/64 inch hexagonal wrench, a 3/32 inch hexagonal wrench and a 5/64 inch hexagonal wrench.

In some embodiments, the radial foldout tool 100 is designed to include some hexagonal wrenches of metric sizes including an 8 mm hexagonal wrench, a 6 mm hexagonal wrench, a 5 mm hexagonal wrench, a 4 mm hexagonal wrench, a 3 mm hexagonal wrench, a 2.5 mm hexagonal wrench, a 2 mm hexagonal wrench and a 1.5 mm hexagonal wrench. It should be apparent to one skilled in the art that a radial foldout tool 100 is able to be formed to hold fewer, additional or different sizes of hexagonal wrenches.

In some embodiments, the radial foldout tool 100 is designed to be of a round shape. In some embodiments, the radial foldout tool 100 is designed to be of a triangular shape including three faces, a square or rectangle shape including four faces, a hexagonal shape including six faces or any other appropriate shape. In some embodiments, a single tool driver is positioned on each face of the radial foldout tool 100. In some embodiments, each face is approximately 1 inch across its width and the body 102 of the radial foldout tool 100 is approximately 4.5 inches in length. The body 102 is designed to provide a comfortable, user-friendly interface to a user's hand, in order to enhance a user's ability to exert rotational pressure on the tool driver 112 without subjecting the user to personal injury or requiring the use of additional tools. As should be apparent to one skilled in the art, the body 102 of the present invention may be designed to be of any convenient shape, including any number of faces.

Figure 6A:
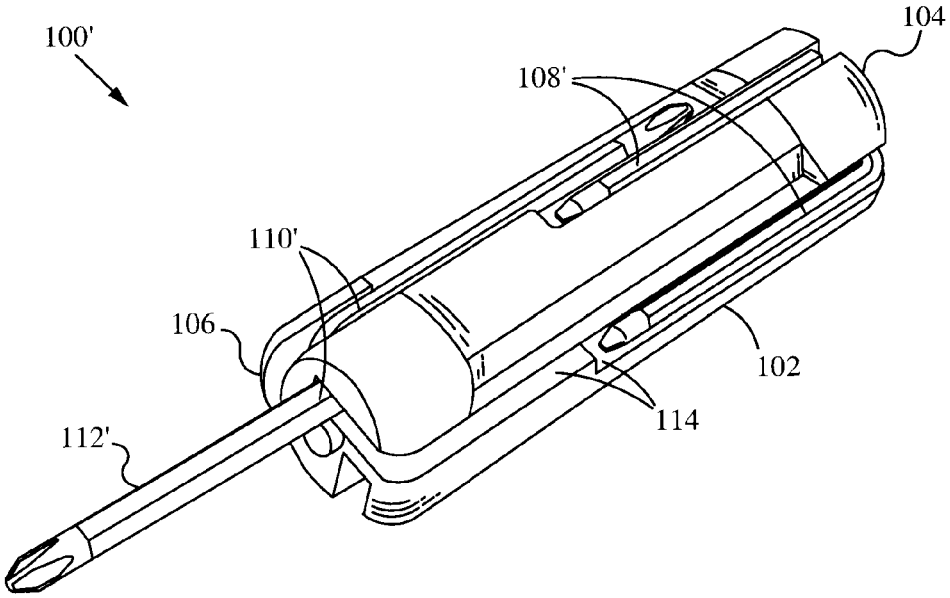
FIG. 6A illustrates a perspective view of a radial foldout tool with alternative tool drivers in accordance with the present invention.
Figure 6B:
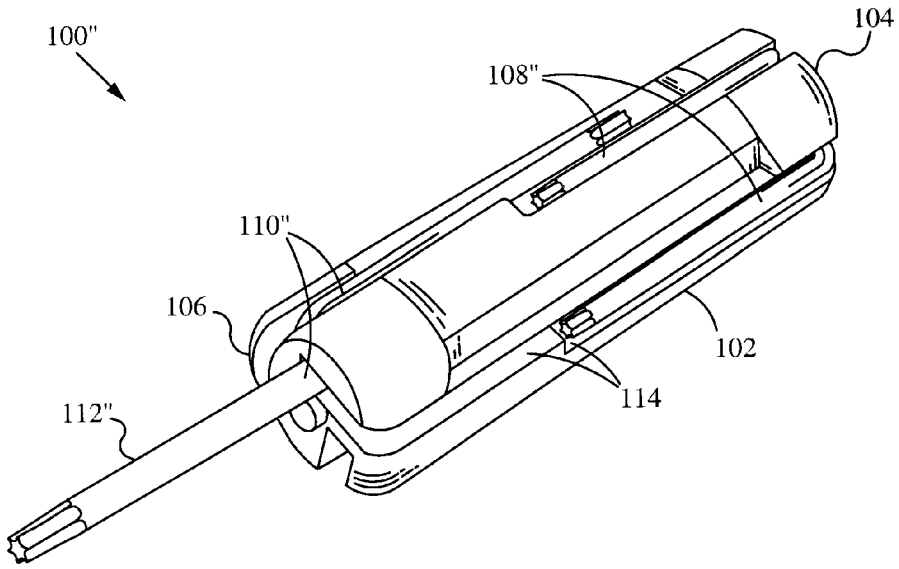
FIG. 6B illustrates a perspective view of a radial foldout tool with alternative tool drivers in accordance with the present invention.
Figure 6C:
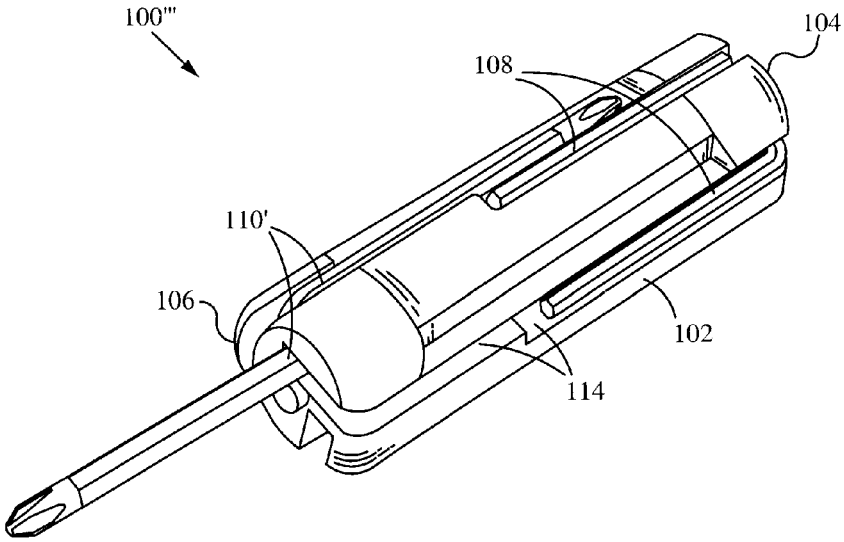
FIG. 6C illustrates a perspective view of a radial foldout tool with alternative tool drivers in accordance with the present invention.

FIGS. 6A, 6B and 6C each illustrates a perspective view of a radial foldout tool with alternative tool drivers in accordance with the present invention. FIG. 6A illustrates a radial foldout tool 100' with screwdrivers as tool drivers 112'. The body 102 is similar to or the same as embodiments above with two opposing ends 104 and 106. Additionally, the channels 114 are also similar to or the same as embodiments above. However, in this embodiment, a first set of tool drivers 108' includes flat head screwdrivers, and the second set of tool drivers 110' includes phillips head screwdrivers. In some embodiments, the sizes and/or shapes of the heads of the screwdrivers vary. For example, the sizes of the screwdriver heads are able to vary to small enough for use with a tiny screw for securing eyeglass components together up to much larger screws. Also, for varying shapes, at times a more pointed screwdriver is necessary for a screw while other times a flatter screwdriver is necessary or preferred. The thickness of the screwdriver tip varies, in some embodiments. In some embodiments, the first set and the second set of tool drivers are all flat head screwdrivers or phillips head screwdrivers. Any variations of screwdrivers are possible.

FIG. 6B illustrates a radial foldout tool 100" with star-shaped drivers as tool drivers 112". As described above in reference to FIG. 6A, the body 102 with two opposing ends 104 and 106 is similar to or the same as well as the channels 114 for previous embodiments. However, in this embodiment, the first and second sets of tool drivers 108" and 110" are star-shaped drivers. The star-shaped drivers vary in size, tip recess (security star) and/or any other characteristic.

FIG. 6C illustrates a radial foldout tool 100''' with both screwdrivers and hexagonal wrenches as tool drivers. Again, the body 102 with two opposing ends 104 and 106 and the channels 114 are similar to or the same as in previous embodiments. However, instead of simply having one type of tool driver, such as hexagonal wrenches, multiple sets of tool drivers are included such as hexagonal wrenches and screwdrivers. In the embodiment shown, a first set of tool drivers 108 includes hexagonal wrenches and a second set of tool drivers 110' includes screwdrivers. Furthermore, the screwdrivers are able to be one type of screwdriver with varying shapes and sizes, and/or are able to include multiple types of screwdrivers such as flat heads and phillips head screwdrivers. While an example of a radial foldout tool with screwdrivers and hexagonal wrenches has been shown, other types of combination tools are possible such as screwdrivers and star-shaped drivers, hexagonal wrenches and star-shaped drivers, hexagonal wrenches and socket wrenches, combinations of three or more tool drivers or any other combinations of tool drivers.

Figure 7:
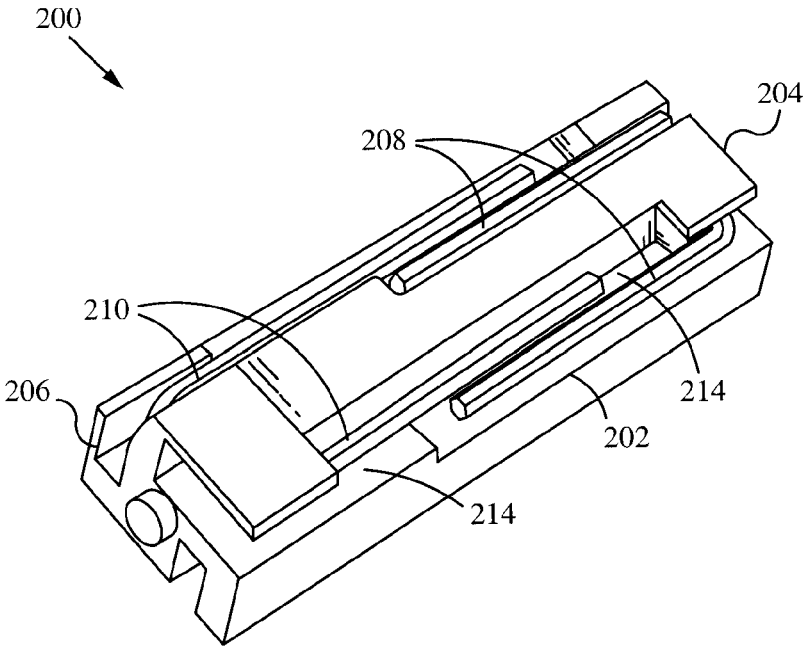
FIG. 7 illustrates a perspective view of a radial foldout tool with a plurality of faces in a closed position in accordance with the present invention.

FIG. 7 illustrates a perspective view of a radial foldout tool 200 with a plurality of faces in a closed position in accordance with the present invention. A first set of tool drivers 208 is coupled to or near a first end 204 of a body 202 of the radial foldout tool 200. The first set of tool drivers 208 is coupled so that the tool drivers 208 are able to rotate out to an open position. In some embodiments, each of the first set of tool drivers 208, when stored in a closed position, fits securely within a different channel 214 of the body 202. A second set of tool drivers 210 is coupled to or near a second end 206 of the body 202 of the radial foldout tool 200. The second set of tool drivers 210 is coupled so that the tool drivers 212 are able to rotate out to an open position. In some embodiments, each of the second set of tool drivers 210, when stored in a closed position, fits securely within a different channel 214 of the body 202. In some embodiments, some of the faces contain two or more tool drivers. In some embodiments, each of the faces contains a single tool driver. As described in detail below, in other embodiments, each of the faces contain at least one tool driver.

As described in this section, the tool drivers in some embodiments are configured to rotate to an open position which is generally in the middle/center of each end of the body of the radial foldout tool. In other words, the tool drivers each folds out to a position as close as possible to a central axis of the radial foldout tool. By being near the middle of each end, turning the radial foldout tool is more stable for a user when the radial foldout tool is in use and each of the tool drivers is in use. The tool drivers are also stored in a plurality of planes in the body which help ensure the tool drivers open to the middle of each end. Since the tool drivers are stored in a plurality of planes, the tool drivers open in a direction at least perpendicular to their neighboring tool driver to further ensure they open to the middle of each end of the radial foldout tool. Previously existing foldout tools suffer from an awkward grasping implementation where the awkwardness is due to the fact that, in the worst case, for example, the previously existing tools allow for the smallest of wrenches to place the part of the tool that is grasped and turned, as far off-axis as possible (and without the benefit of a hard stop in the fully extended position as the present radial foldout tool does). In addition to that, since the previously existing tools are rectangular cubes, the user's hand is required to either fully disengage the tool between turns, or to use rather involved spider-like, alternating stepping actions with the fingers to crawl the hand around the tool into position for the next twist, all the while, keeping the tool stabilized in multiple axes due to the fact that the grasp is compromised and that the wrench, when fully extended, is able to rotate at least 270°. Whereas, with the present radial foldout tool design, the user's hand is able to simply loosen the grasp and slide the palm around within the circumference of the tool while maintaining a steady and sure grasp on the tool, wrench and fastener.

Biaxial Foldout Tool

Figure 8A:
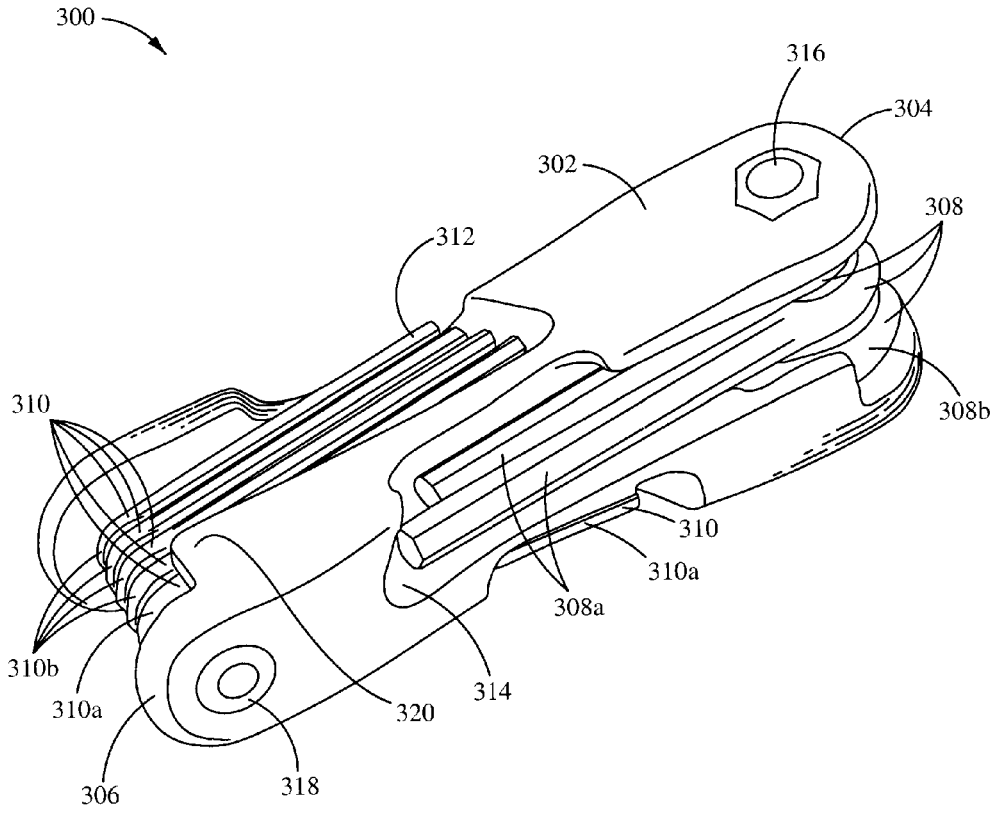
FIG. 8A illustrates a first perspective view of a radial foldout tool having multiple tool drivers positioned on each face in a closed positioned in accordance with the present invention.
Figure 8B:
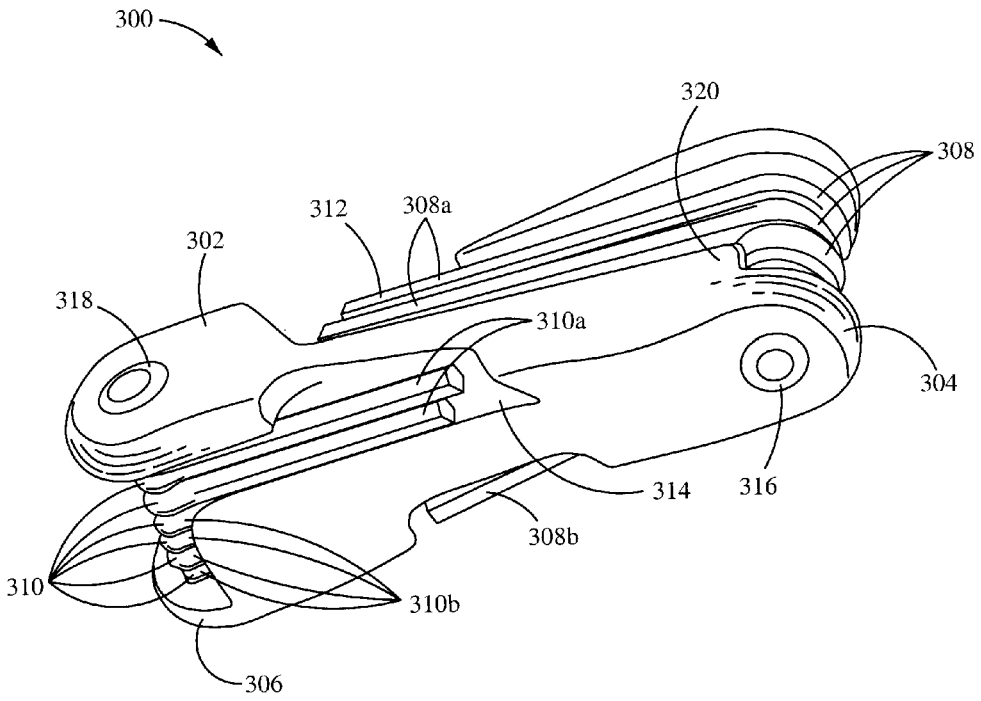
FIG. 8B illustrates a second perspective view of a radial foldout tool having multiple tool drivers positioned on each face in a closed positioned in accordance with the present invention.
Figure 8C:
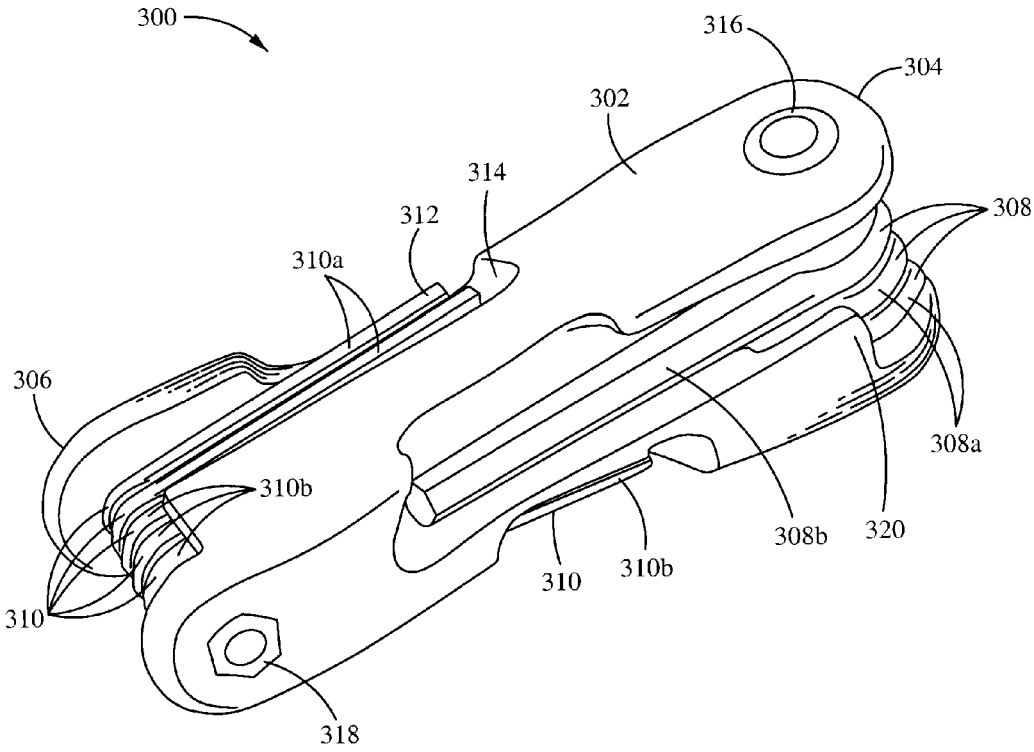
FIG. 8C illustrates a third perspective view of a radial foldout tool having multiple tool drivers positioned on each face in a closed positioned in accordance with the present invention.
Figure 8D:
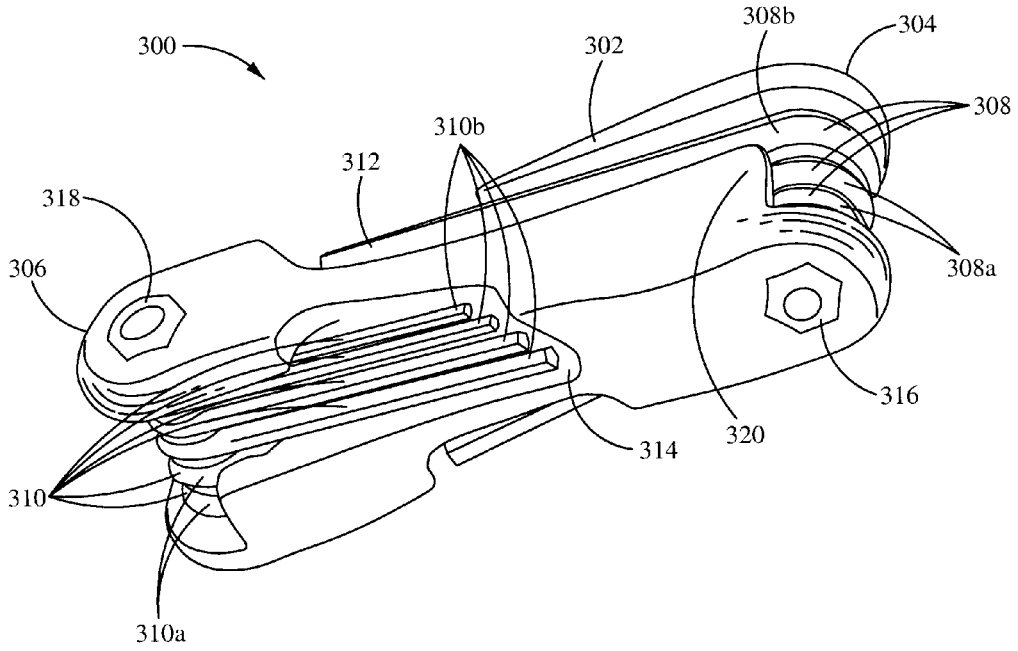
FIG. 8D illustrates a fourth perspective view of a radial foldout tool having multiple tool drivers positioned on each face in a closed positioned in accordance with the present invention.

As described above, in some embodiments, multiple tool drivers are positioned on each face of a foldout tool. FIGS. 8A, 8B, 8C and 8D each illustrate a perspective view of a biaxial foldout tool 300 having multiple tool drivers positioned on each face in a closed position in accordance with the present invention. The biaxial foldout tool 300 has a body 302 that generally includes four faces; a first face is opposite of a third face, and a second face is opposite of a fourth face. FIG. 8A illustrates a first perspective view of the biaxial foldout tool 300 showing the first face and the fourth face. FIG. 8B illustrates a second perspective view of the biaxial foldout tool 300 showing the first face and the second face. FIG. 8C illustrates a third perspective view of the biaxial foldout tool 300 showing the second face and the third face. FIG. 8D illustrates a fourth perspective view of the biaxial foldout tool 300 showing the third face and the fourth face.

In some embodiments, a first set of tool drivers 308 is coupled to or near a first end 304 of the body 302 of the biaxial foldout tool 300. Each tool driver 312 of the first set of tool drivers 308 is coupled so that it is able to rotate out to an open position via a first hinge 316. In some embodiments, when the first set of tool drivers 308 is stored in a closed position, tool drivers 312 fit securely within channels 314 of the body 302. A second set of tool drivers 310 is coupled to or near a second end 306 of the body 302 of the biaxial foldout tool 300. Each tool driver 312 of the second set of tool drivers 310 is coupled so that it is able to rotate out to an open position via a second hinge 318. In some embodiments, when the second set of tool drivers 310 is stored in a closed position, tool drivers 312 fit securely within channels 314 of the body 302.

In some embodiments, each tool driver 312 of the first set of tool drivers 308 is configured to fully open in parallel with the body 302 and an opposite direction of the other tool drivers 312 in the first set of tool drivers 308. Similarly, in some embodiments, each tool driver 312 of the second set of tool drivers 310 is configured to fully open in parallel direction with the body 302 and an opposite direction of the other tool drivers 312 in the second set of tool drivers 310.

In some embodiments, while each tool driver 312 of the first set of tool drivers 308 rotates about the first hinge 316, a first portion 308*a* of the first set of tool drivers 308 fits securely within a channel 314 on the first face of the biaxial foldout tool 300, and a second portion 308*b* of the first set of tool drivers 308 fit securely within a channel 314 on the third face of the biaxial foldout tool 300. The tool drivers 312 of the first portion 308*a* open in a direction counter to the direction of the tool drivers 312 of the second portion 308*b*. Similarly, in some embodiments, while each tool driver 312 of the second set of tool drivers 310 rotates about the second hinge 318, a first portion 310*a* of the second set of tool drivers 310 fits securely within a channel 314 on the second face of the biaxial foldout tool 300, and a second portion 310*b* of the second set of tool drivers 310 fits securely within a channel 314 on the fourth face of the biaxial foldout tool 300. The tool drivers 312 of the first portion 310*a* open in a direction counter to the direction of the tool drivers 312 of the second portion 310*b*.

The first hinge 316 typically couples together the second face and the fourth face. The second hinge 318 typically couples together the first face and the third face. In other words, the ends 304, 306 of the biaxial foldout tool 300 are rotated or twisted approximately 90° from each other, such that ends of each hinge are on each face of the biaxial foldout tool 300. Although the biaxial foldout tool 300 has four faces, the 90° rotation creates a more cylindrical body, thereby providing a user with a better grasp of the biaxial foldout tool 300 while tightening or loosening an object such as a screw or bolt.

The biaxial foldout tool 300 in some embodiments is designed to include some hexagonal wrenches of English (e.g., standard) sizes. In some embodiments, the first portion 308*a* of the first set of tool drivers 308 includes a 3/16 inch hexagonal wrench and a 7/32 inch hexagonal wrench, while the second portion 308*b* of the first set of the tool driver 308 includes a 1/4 inch hexagonal wrench. In some embodiments, the first portion 310*a* of the second set of tool drivers 310 includes a 9/64 inch hexagonal wrench and a 5/32 inch hexagonal wrench, while the second portion 310*b* of the second set of the tool driver 310 includes a 5/64 inch hexagonal wrench, 3/32 inch hexagonal wrench, 7/64 inch hexagonal wrench, and 1/8 inch hexagonal wrench.

The biaxial foldout tool 300 in other embodiments is designed to include some hexagonal wrenches of metric sizes. In some embodiments, the first portion 308*a* of the first set of tool drivers 308 includes a 5 mm hexagonal wrench and a 6 mm hexagonal wrench, while the second portion 308*b* of the first set of the tool driver 308 includes an 8 mm hexagonal wrench. In some embodiments, the first portion 310*a* of the second set of tool drivers 310 includes a 4 mm hexagonal wrench and a 4.5 mm hexagonal wrench, while the second portion 310*b* of the second set of the tool driver 310 includes a 2 mm hexagonal wrench, 2.5 mm hexagonal wrench, 3 mm hexagonal wrench, and a 3.5 mm hexagonal wrench. It should be apparent to one skilled in the art that a biaxial foldout tool 300 is able to be formed to hold fewer, additional or different sizes of hexagonal wrenches.

In some embodiments, the tool drivers are grouped into sets depending on a predetermined characteristic such as size. For example, each tool driver of a set of tool drivers is larger than each tool driver of another set of tool drivers. In addition or alternatively, each tool driver of a portion of a set of tool drivers is positioned within a channel 314 in a predetermined order such as size. For example, a largest tool driver of a portion is positioned towards a centerline of the body 300, and a smallest tool driver is positioned towards an outside of the channel 314. As such, in an open position, the largest tool driver is generally in the middle of the body 302. Having the largest tool driver generally in the middle of the body 302 advantageously provides a more even torque during usage. Alternatively, the largest tool driver of a portion is positioned towards the outside of the channel 314, and the smallest tool driver is positioned towards the inside of the channel 314.

Figure 9:
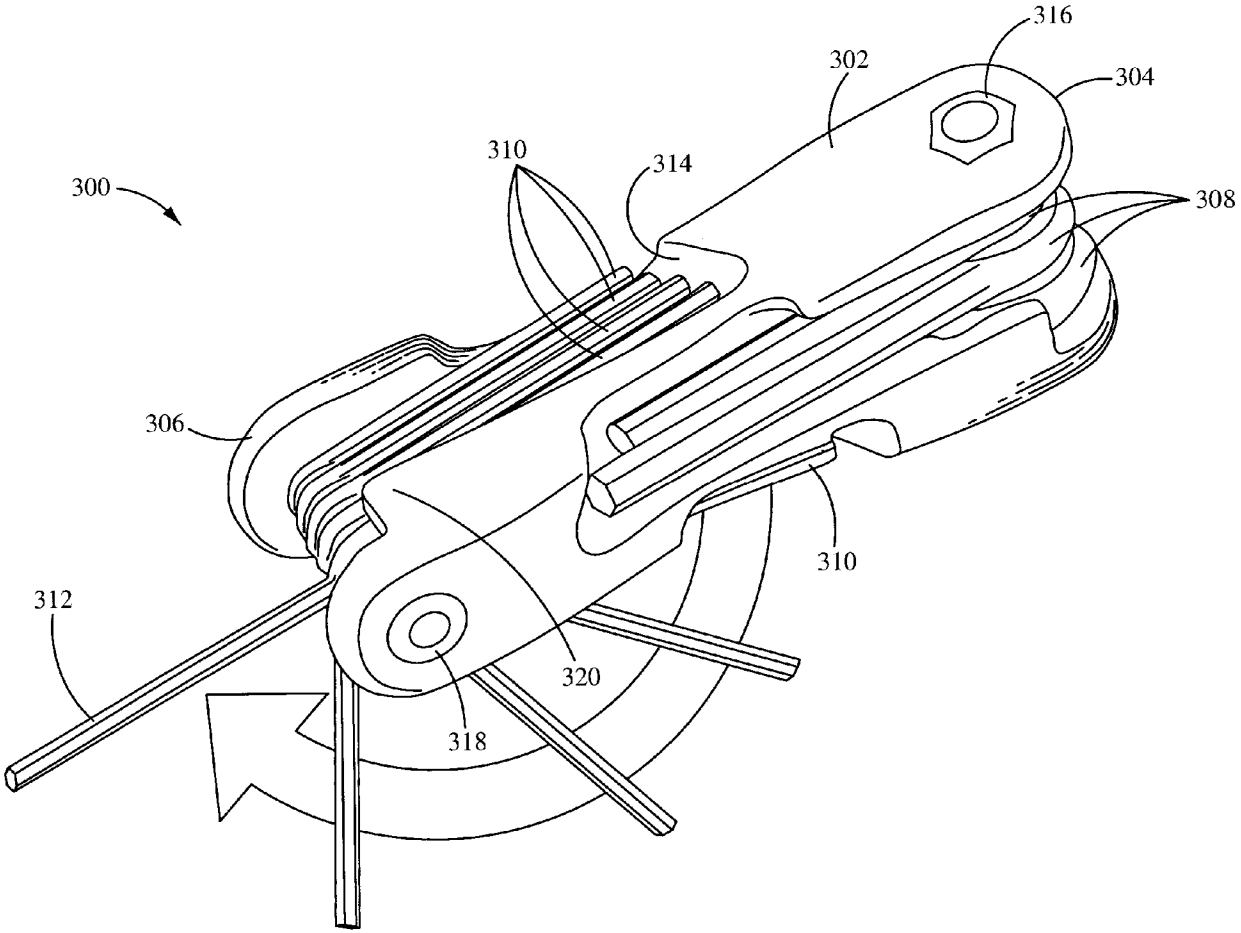
FIG. 9 illustrates a perspective view of a radial foldout tool with a tool driver moving from a closed position to an open position in accordance with the present invention.

FIG. 9 illustrates a perspective view of a biaxial foldout tool 300 with a tool driver moving from a closed position to an open position in accordance with the present invention. When positioned in a closed position, the tool driver 312 is stored within a channel 314, in some embodiments. A user is able to rotate the tool driver 312 to an open position as shown. In some embodiments, the tool driver 312 is limited in the direction it is able to rotate, such that it rotates away from the channel in which it is stored. Furthermore, the tool driver's rotational range is limited so that the tool driver 312 stops rotating once it is pointing in a parallel direction to the body 302. In some embodiments, a hard stop such as an internal wall 320 prevents the tool driver from opening past a predetermined angle such as 90° or 180°. To position the tool driver 312 in a closed position, a user rotates the tool driver 312 in an opposite direction from the opening direction so that the tool driver 312 rests within the channel 314, in some embodiments.

Figure 10A:
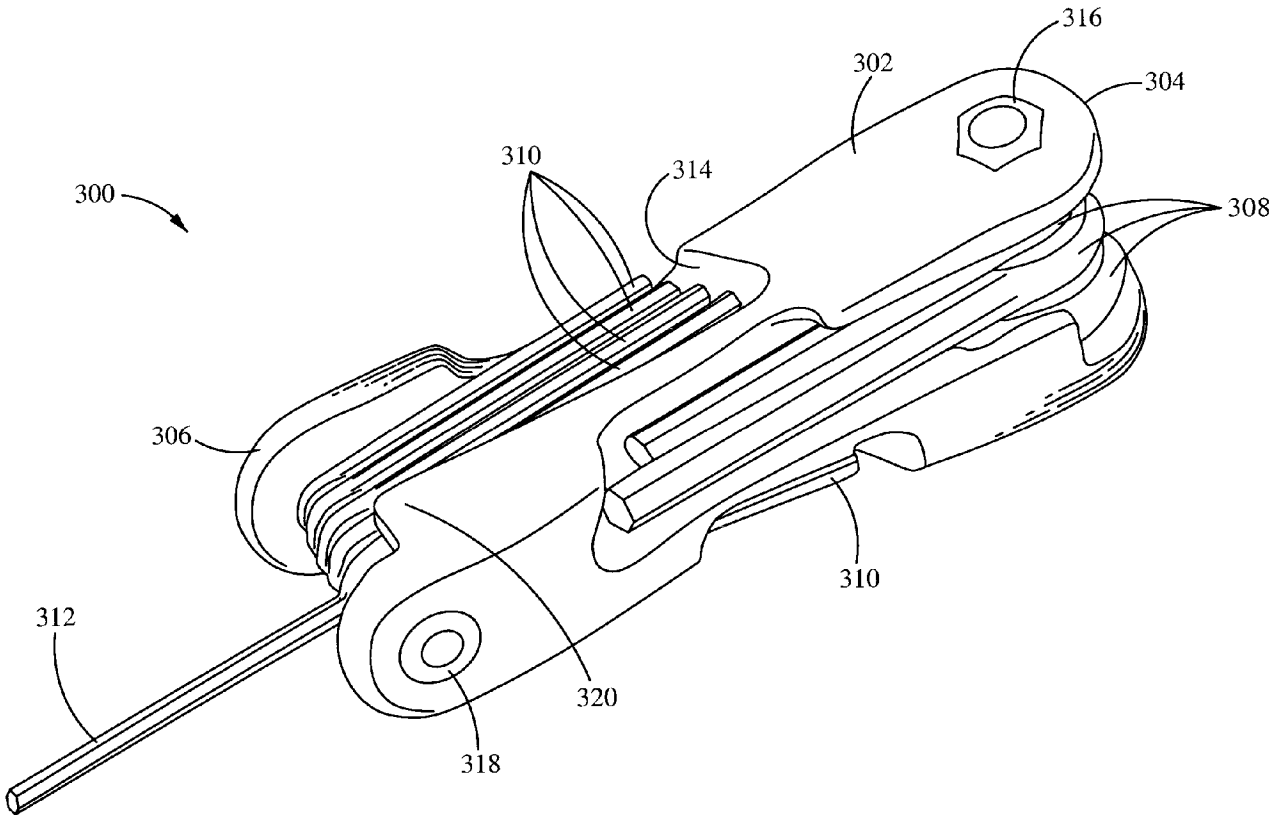
FIG. 10A illustrates a perspective view of a radial foldout tool in a 180° open position in accordance with the present invention.

FIG. 10A illustrates a perspective view of a biaxial foldout tool 300 in a 180° open position in accordance with the present invention. When in a 180° open position, a tool driver 312 is positioned pointing in a parallel direction to the body 302. This enables users to grip the body 302 as a handle and use the biaxial foldout tool 300 similarly to a screw driver or other tool that has a body with a tool driver protruding out of the middle of the handle. The biaxial foldout tool 300 is intended to be used with one of the tool 312 in a 180° open position. While one of the tool drivers 312 is in a 180° open position, the other tool drivers 312 are in a closed position.

Figure 10B:
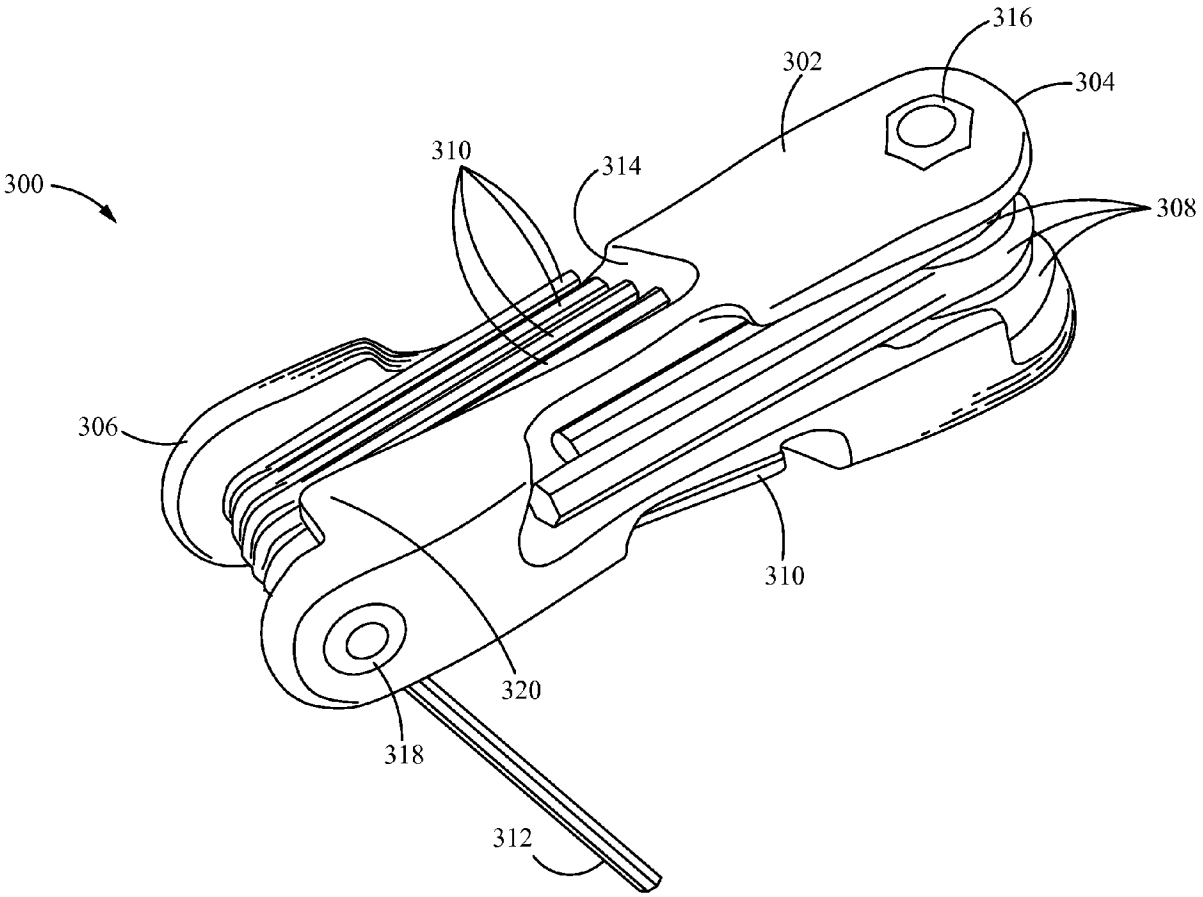
FIG. 10B illustrates a perspective view of a radial foldout tool in a 90° open position in accordance with the present invention.

FIG. 10B illustrates a perspective view of a biaxial foldout tool 300 in a 90° open position in accordance with the present invention. When in a 90° open position, a tool driver 312 is positioned pointing in a perpendicular direction to the body 302. The user is able to grip the body 302 as a handle during, for example, the starting and/or the finishing of hardware since the user is able to generate the most torque using this configuration. The biaxial foldout tool 300 is intended to be used with one of the tool 312 in a 90° open position. While one of the tool drivers 312 is in a 90° open position, the other tool drivers 312 are in a closed position.

Figure 11A:
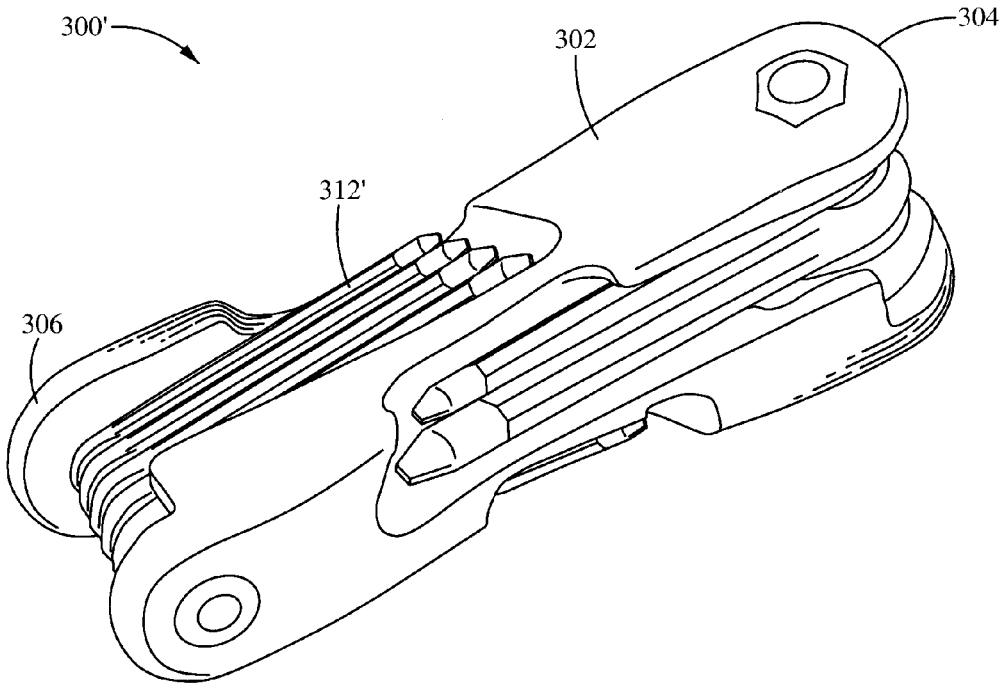
FIG. 11A illustrates a perspective view of a radial foldout tool with alternative tool drivers in accordance with the present invention.
Figure 11B:
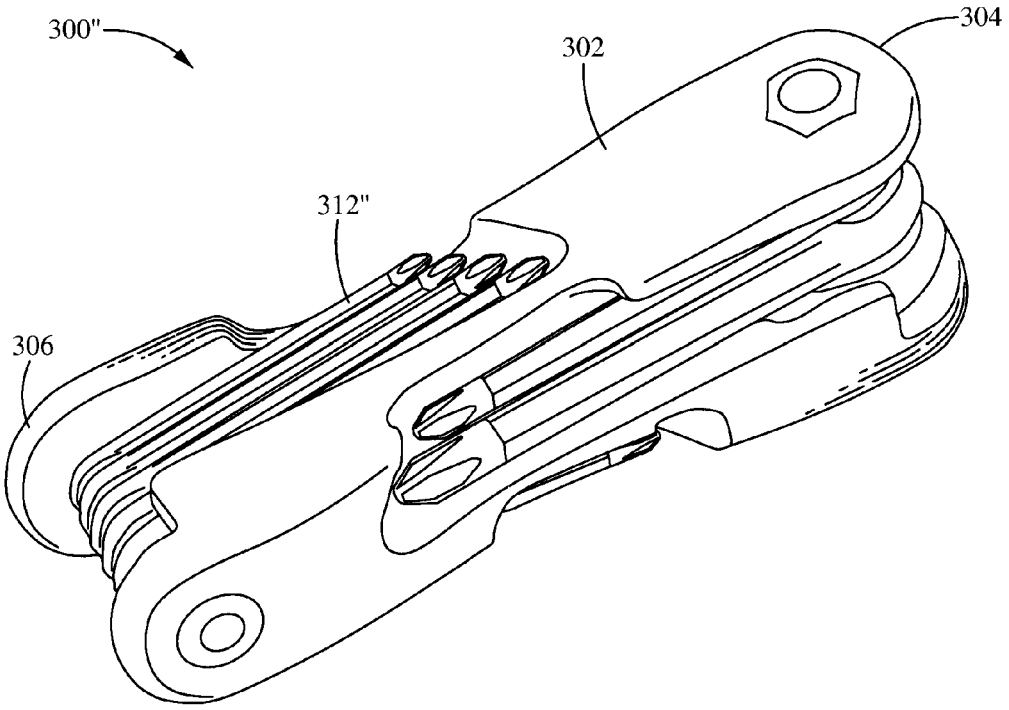
FIG. 11B illustrates a perspective view of a radial foldout tool with alternative tool drivers in accordance with the present invention.
Figure 11C:
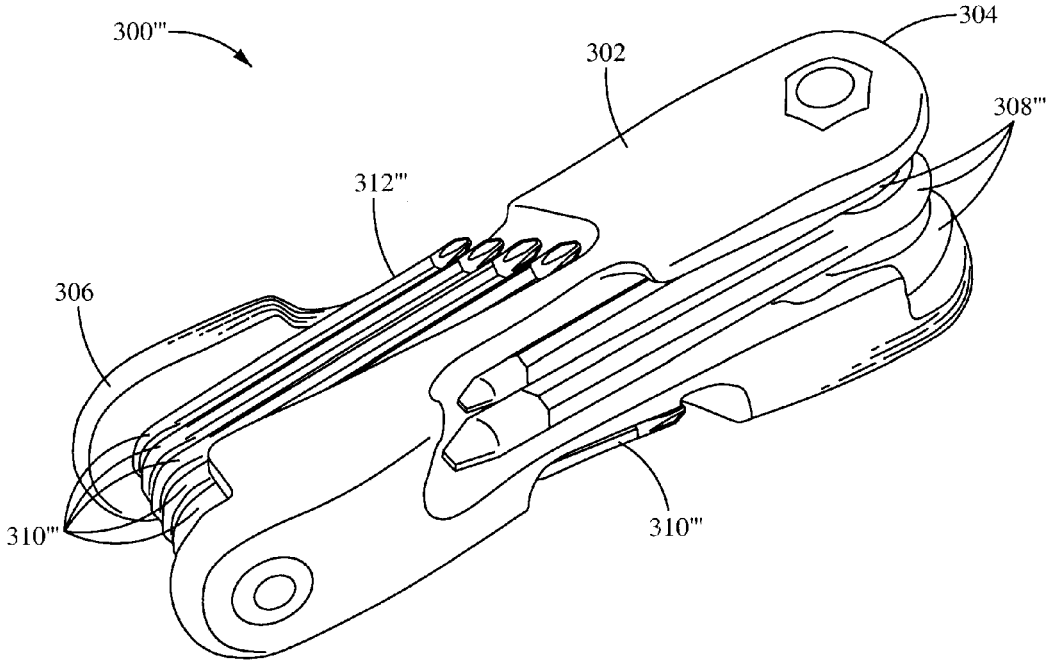
FIG. 11C illustrates a perspective view of a radial foldout tool with alternative tool drivers in accordance with the present invention.

FIGS. 11A, 11B and 11C each illustrates a perspective view of a biaxial foldout tool with alternative tool drivers. FIG. 11A illustrates a biaxial foldout tool 300' with flat head screwdrivers as tool drivers 312'. FIG. 11B illustrates a biaxial foldout tool 300" with phillips head screwdrivers as tool drivers 312". FIG. 11C illustrates a biaxial foldout tool 300''' with both flat head screwdrivers and phillips screwdrivers as tool drivers 312'''; the flat head screwdrivers are part of a first set of tool drivers 308''' and the phillips head screwdrivers are part of a second set of tool drivers 310'''. As illustrated, the biaxial foldout tool 300', the biaxial foldout tool 300" and the biaxial foldout tool 300''' are similarly configured as the biaxial foldout tool 300, except that the tool drivers are different. It should be understood that different combinations of tool drivers are possible. It should also be understood that each tool driver can be different from the other tool drivers.

As described in this section, the tool drivers in some embodiments are configured to rotate to an open position via hinges. Each side of the body of the biaxial foldout tool contains at least one tool driver. Since the ends of the biaxial foldout tool are rotated approximately 90° from each other, the body is more cylindrical in shape, providing a user with a better grasp of the biaxial foldout tool as compared to previously existing tools that are rectangular cubes. Furthermore, a more cylindrical shape advantageously allows for more tool drivers to be coupled to the biaxial foldout tool as one unit.

Composition of the Body

A body of a foldout tool (e.g., radial or biaxial) is able to be composed of any appropriate material, which is of maximum strength and includes properties which resist materials that the handle will likely be exposed to, e.g., oil, grease, gasoline and the like. In some embodiments, the body is materially composed of 30% glass-filled polypropylene or nylon. In some embodiments, the body is materially composed of any suitable composition including, but not limited to aluminum or steel. In some embodiments, tool drivers are materially composed of aluminum, steel or any other appropriate material. In some embodiments, the body is constructed using an injection molded, core/cavity process as is well known in the art. Alternatively, the body may be constructed in any known manner.

Operation

In operation, a foldout tool (e.g., radial or biaxial) contains multiple tool drivers to consolidate the space needed for a set of tool drivers. Furthermore, the body of the foldout tool contains channels for storing the tool drivers in a closed position, so that more tools are able to be stored. To utilize the foldout tool, a user moves a desired tool driver from a closed position to an open position. In some embodiments, the open position as at 90° (e.g., the desired tool driver is perpendicular to the body). In other embodiments, the open position is at 180° (e.g., the desired tool driver is parallel to the body). The user moves the desired tool driver using a finger or two to simply pull or push the tool driver in the appropriate direction. In some embodiments, the tool driver locks into place in the open position. The user then grasps the body of the foldout tool similarly to grasping a handle of a screwdriver. The user turns the body of the foldout tool to either tighten or loosen an object such as a screw or bolt. This turning action is also similar to the use of a screwdriver. Once the user has performed the tightening or loosening actions on the desired object or objects, the tool driver is moved to a closed position by pushing or pulling the tool driver with the user's fingers. In some embodiments, the tool drivers lock in the closed position. When in the closed position, the tools are safely stored within channels in the body to prevent injuries. Unlike a standard screwdriver which has a sharp point jutting out of the handle, the foldout tool is able to be compacted and stored safely.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A utility tool comprising:

a. a first end comprising a first hinge and one or more tool drivers configured to rotate to an open position about the first hinge in a plurality of different directions; and b. a second end comprising a second hinge non-parallel to the first hinge and one or more tool drivers configured to rotate about the second hinge.

2. The utility tool of claim 1 wherein the one or more tool drivers of the first end and the one or more tool drivers of the second end are grouped according to size.

3. The utility tool of claim 1 wherein the tool comprises an internal stop configured to prevent the one or more tool drivers of the first end and the one or more tool drivers of the second end from opening past an angle.

4. The utility tool of claim 1 wherein the second hinge is rotated 90° in orientation from the first hinge.

5. The utility tool of claim 1 wherein the one or more tool drivers of the first end and the one or more tool drivers of the second end are stored in one or more channels of the utility tool when not in use.

6. The utility tool of claim 1 wherein the first end and the second end each comprise one or more tool drivers on a first side and a second side opposite the first side.

7. The utility tool of claim 6 wherein the tool drivers of the first side and the one or more tool drivers of the second side open in opposite directions.

8. A utility tool comprising:

a. a first end and a second end each comprising a plurality of rotatable tool drivers;

b. a hinge coupled to the first end;

c. a first tool driver configured to rotate to an open position about the first hinge; and d. a second tool driver configured to rotate to an open position about the first hinge and in a opposite direction from the first tool driver.

9. The utility tool of claim 8 comprising a second hinge non-parallel to the first hinge and one or more tool drivers configured to rotate about the second hinge.

10. The utility tool of claim 9 wherein the second hinge is rotated 90° in orientation from the first hinge.

11. The utility tool of claim 8 wherein the tool drivers are grouped according to size.

12. The utility tool of claim 8 wherein the tool comprises an internal stop configured to prevent the tool drivers from opening past an angle.

13. The utility tool of claim 8 wherein the tool drivers are stored within one or more channels when not in use.

14. A utility tool comprising:

a. a body comprising a first end, a second end each comprising a plurality of rotatable tool drivers and four sides; and b. a first channel and a second channel each holding one or more rotatable tool drivers, and wherein the first channel and the second channel are on opposite sides of the same end, and further wherein the one or more rotatable tool drivers of the first channel and the second channel rotate to an open position about the same hinge.

15. The utility tool of claim 14 wherein the one or more rotatable tool drivers of the first channel and the one or more rotatable tool drivers of the second channel are configured to rotate in opposite directions to an operative position.

16. The utility tool of claim 15 wherein the one or more rotatable tool drivers of the first channel and the one or more rotatable tool drivers of the second channel rotate about a same first hinge.

17. The utility tool of claim 16 comprising a second hinge non-parallel to the first hinge and one or more tool drivers configured to rotate about the second hinge.

18. The utility tool of claim 17 wherein the second hinge is rotated 90° in orientation from the first hinge.

19. The utility tool of claim 14 wherein the tool drivers are grouped according to size.

20. The utility tool of claim 14 wherein the tool comprises an internal stop configured to prevent the tool drivers from opening past an angle.

* * * * *